US007975615B1

(12) United States Patent
Apple

(10) Patent No.: US 7,975,615 B1
(45) Date of Patent: Jul. 12, 2011

(54) AEROSOL SMOKE GRENADE

(75) Inventor: Thomas A. Apple, Suffolk, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 227 days.

(21) Appl. No.: 12/431,111

(22) Filed: Apr. 28, 2009

Related U.S. Application Data

(60) Provisional application No. 61/165,571, filed on Apr. 1, 2009.

(51) Int. Cl.
*F42B 5/145* (2006.01)

(52) U.S. Cl. ..... 102/512; 102/513

(58) Field of Classification Search ..... 102/502, 102/512, 513
See application file for complete search history.

(56) References Cited

U.S. PATENT DOCUMENTS

| | | | | |
|---|---|---|---|---|
| 3,831,520 | A | 8/1974 | Bowen et al. | |
| 4,195,572 | A | 4/1980 | Knapp | |
| 4,627,354 | A | 12/1986 | Diamond et al. | |
| 4,667,601 | A | 5/1987 | Diamond et al. | |
| 5,069,134 | A * | 12/1991 | Pinkney | 102/368 |
| 6,047,644 | A | 4/2000 | Malecki et al. | |
| 6,250,226 | B1 | 6/2001 | Leichter et al. | |
| 6,349,650 | B1 * | 2/2002 | Brunn et al. | 102/368 |

* cited by examiner

*Primary Examiner* — Stephen M Johnson
(74) *Attorney, Agent, or Firm* — Richard A. Morgan

(57) ABSTRACT

The invention is an aerosol search and rescue (SAR) grenade. A smoke signal is produced that is comparable to the smoke signal produced by a pyrotechnic grenade. An aspirating provides a propellant gas/air mixture to a reservoir of smoke material. A container configuration and gravity operated valve provide for a smoke plume only in the upward direction. The smoke grenade is useful in life rafts. It is also useful in inland areas posing a risk of fire.

22 Claims, 3 Drawing Sheets

AEROSOL SMOKE GRENADE

CROSS-REFERENCE TO RELATED APPLICATION

This application claims the benefit of U.S. Provisional Application No. 61/165,571, filed Apr. 1, 2009, which is incorporated herein by reference.

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

The invention relates to ammunition and explosives. More particularly, the invention relates to a smoke marker. Most particularly the invention relates to an aerosol dispersing grenade.

2. Discussion of the Related Art

The invention relates to a military search and rescue (SAR) grenade. Smoke marker grenades are stowed in life rafts for use in rescue at sea. Smoke marker grenades are also used on land to draw attention and to mark a geographical position.

Most smoke grenades comprise a hand held body which contains a smoke forming charge, a discharge composition and a primer/bursting charge to activate the discharge composition and generate the smoke. The smoke grenade is set off by igniting the primer, which in turn ignites the smoke charge and the discharge composition. The grenade body functions as a pressure vessel to contain the ignition and initial combustion long enough for the smoke to be generated and then to facilitate discharge of the burning contents as smoke. A disadvantage of the ignition type smoke grenade is the discharge of ignition and combustion products that can cause fires in the surrounding area. This is undesirable on land, in a life raft at sea and in most military and civilian environments.

Non-incendiary aerosol smoke dispersing grenades have been developed which overcome the danger of starting fires when producing smoke. These grenades rely on an aerosol can of pressurized propellant gas. The propellant gas is released through a valve and carries a quantity of solid particles or liquid into the atmosphere to create a smoke plume. The size of the smoke plume produced is limited by the amount of propellant gas in the aerosol can.

Inventor has discovered that the problems and deficiencies associated with known incendiary and non-incendiary smoke grenades and can be solved or greatly reduced by the use of an aerosol smoke grenade.

SUMMARY OF THE INVENTION

An aerosol smoke grenade comprises a hand held canister. The canister has a curved side wall. A cross-section of the curved side wall displays a major axis and a minor axis. The major axis is longer than the minor axis. Inside the body are at least one gas cartridge and an actuator for initiating flow of gas from the cartridge to an aspirating nozzle. An aspirating nozzle has at least one air aspiration port and a discharge end. The nozzle discharges to a powder reservoir. The powder reservoir has a discharge conduit which transports gas and powder to two powder discharge ports traversing the side wall. The discharge ports are located on the side wall proximate opposite ends of the minor axis.

The hand held grenade is actuated and thrown. The shape of the curved side wall causes the grenade to come to rest in a position such that one smoke discharge port is pointing up and one is pointing down. The discharge port pointing down is stopped. This results in a smoke plume directed upward. The air aspiration nozzle forms a smoke plume of greater size than could be produced by the gas cartridge alone.

DETAILED DESCRIPTION OF THE INVENTION

Figure 1:
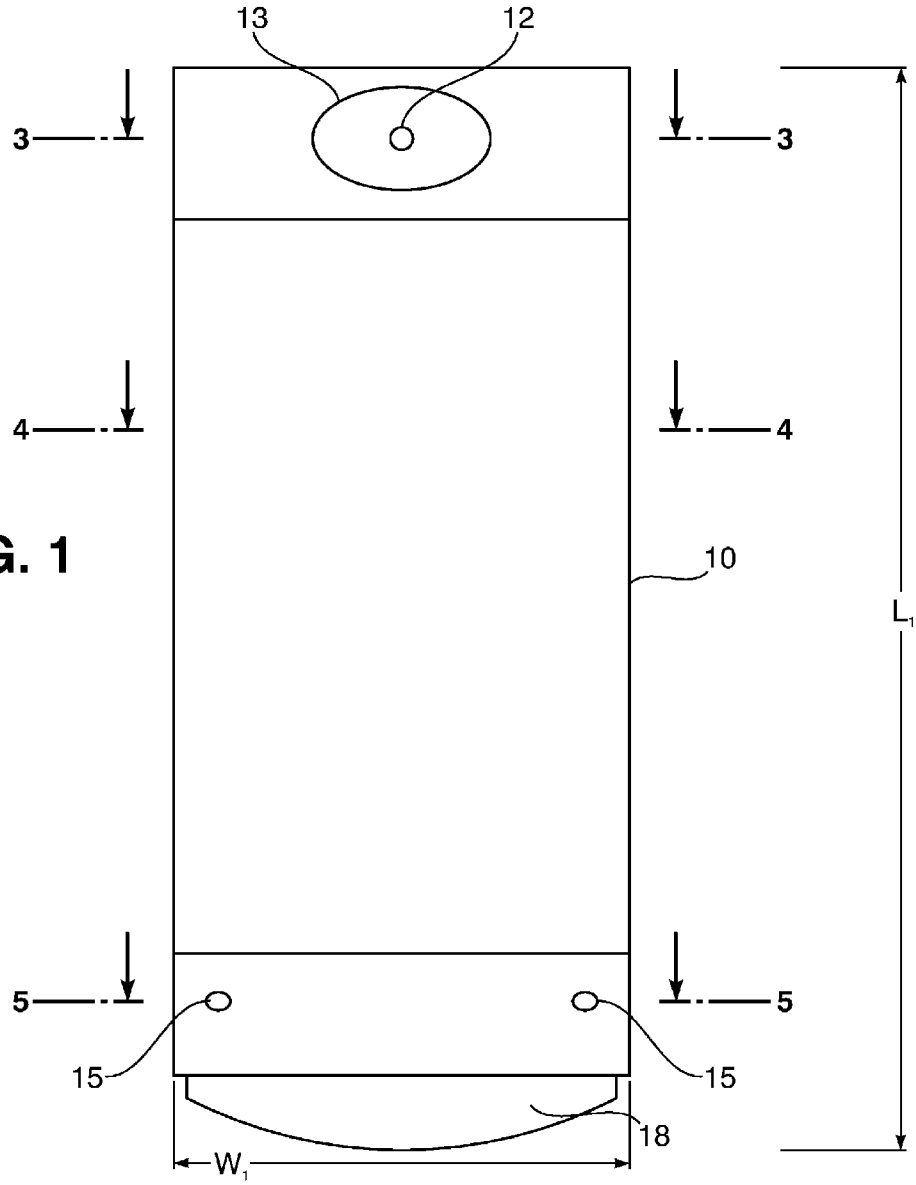
FIG. 1 is an overhead view of an aerosol smoke grenade.

The invention is described with reference to the drawing. The drawing discloses a preferred embodiment of the invention and is not intended to limit the generally broad scope of the invention as set forth in the claims.

Figure 1A:
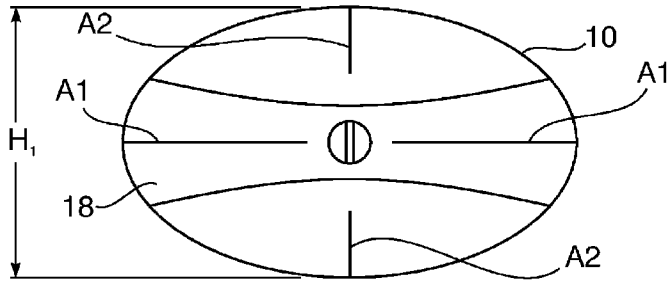
FIG. 1*a* is an end view of the aerosol smoke grenade of FIG. 1.

Reference is made to FIG. 1 and FIG. 1*a* showing a non-incendiary aerosol smoke grenade. The grenade has dimensions that allow it to be held in the hand and thrown. In this embodiment, the grenade has a length $L_1$ of 8 inches, a width $W_1$ of 3.5 inches and a height $H_1$ of 2 inches. The appearance of the grenade is that of the outer canister or body 10. The canister has a continuously curved side wall made of plastic. In the end view shown in FIG. 1*a*, the curved side wall is generally oval or elliptical in shape. The curved side wall has a major axis A1 and a minor axis A2. The proportions of the body are critical in that the length of the major axis A1 is always greater than the length of the minor axis A2. Numerically, the major axis is greater in length than the minor axis by a ratio of 4:1 to 1.5:1, typically 2.5:1 to 1.5:1. This, together with the continuously curved side wall assure that the thrown grenade will land and come to rest with one powder discharge port 12 pointing upward and one powder discharge port 14 pointing downward.

Figure 3:
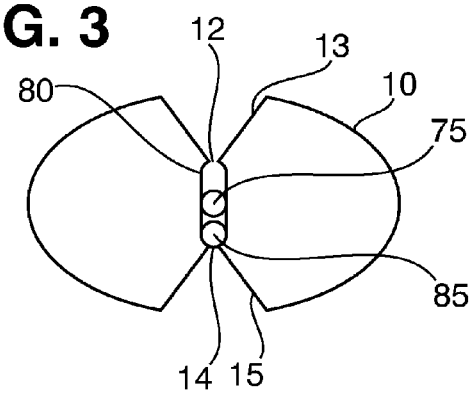
FIG. 3 is a sectional side view of the aerosol smoke grenade of FIG. 1 along section 3-3.

The powder discharge port 12 is indented from the surface of the side wall by the depth of spray cone 13, shown in FIG. 3. Twist knob 18 provides for manual initiation of the smoke grenade. Bolt 19 attaches twist knob 18 to the grenade. Air aspirating ports 15 are also shown.

Figure 2:
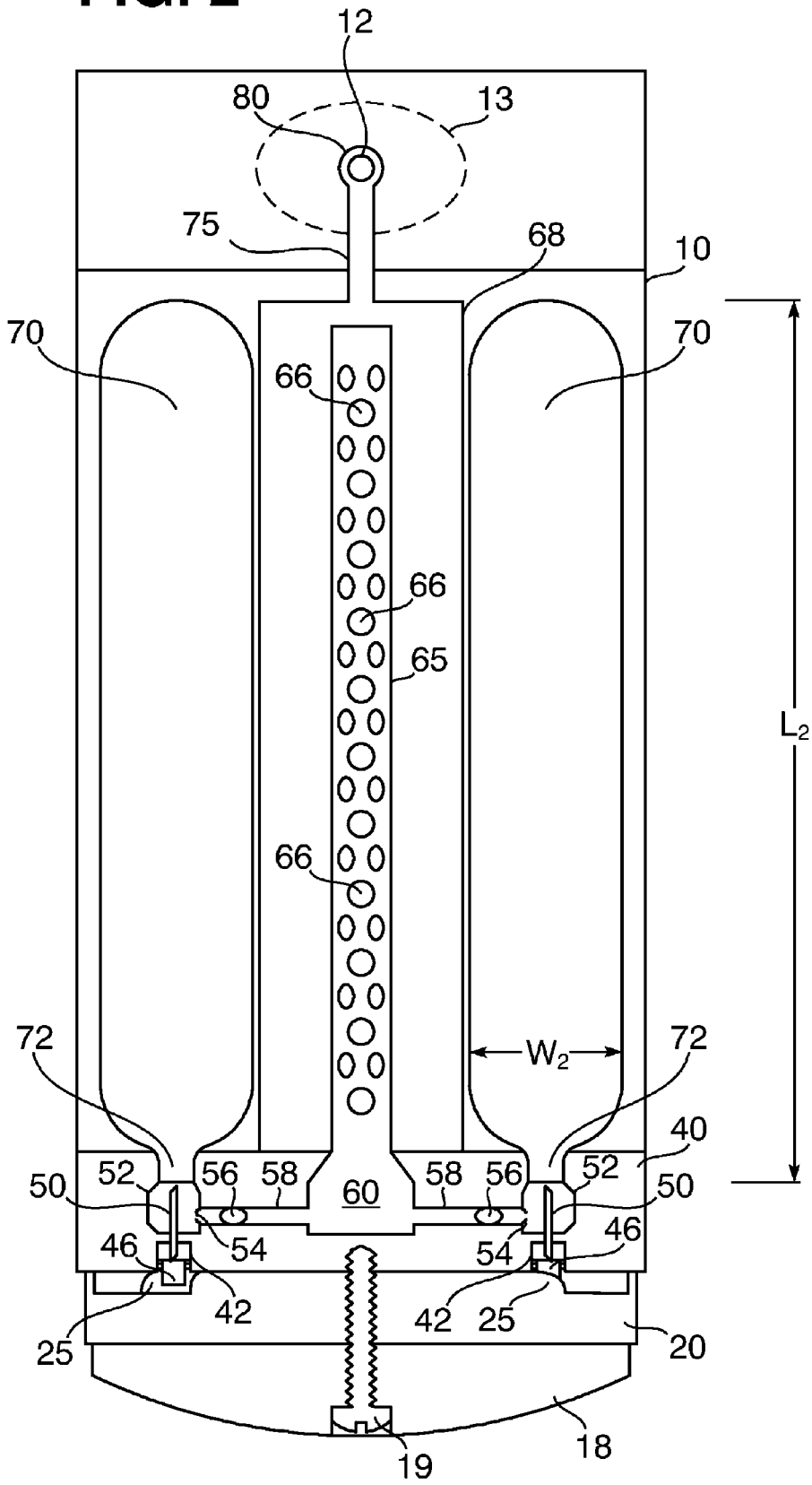
FIG. 2 is an overhead cross-sectional view of the aerosol smoke grenade of FIG. 1.

Reference is made to FIG. 2. Bolt 19 attaches twist knob 18 through bayonet block 20 to mounting block 40. Mounting block 40 has two bayonet sleeves 42. Each sleeve provides for travel of a bayonet piston 46. In each sleeve is positioned a bayonet assembly including a bayonet piston 46 attached to a grooved metal bayonet 50.

Twist knob 18 is directly attached to bayonet block 20 and the two are manually rotated 10° to 30° on bolt 19 which is an axis of rotation. Bayonet block 20 includes ramps 25 in contact with bayonet pistons 46. The left ramp 25 is shown with bayonet piston 46 in front of it. The right ramp 25 is shown in front of the bayonet piston 46. As bayonet block 20 is rotated, bayonet piston 46 is forced up bayonet sleeve 46 for bayonet 50 to puncture the neck 68 of gas cartridge 70. Two gas cartridges 70 are shown. There could be one or more than two. The limit is the desire for simplicity of construction and that the grenade be hand held. In this embodiment the gas cartridges have a diameter $W_2$ of 1.38 inch and a cylindrical body length $L_2$ of 7.48 inches. The cylinder 70 has an internal volume of 114 cubic centimeters (cc) and contains 86 grams of carbon dioxide gas ($CO_2$). These gas cylinders and bayonets are available commercially from Leland® Gas Technologies, 1611 Canady Road, Wilmington, N.C. 28411. Equivalent cylinders are available in a number of sizes containing carbon dioxide, Freon® or nitrogen.

Carbon dioxide gas flows through the neck 72 of cylinder 70 into expansion chamber 52 in mounting block 40 to confront rupture disc 54. Expansion chamber 52 and rupture disc 54 provide a few seconds delay, e.g. 2 to 3 seconds, in the initial flow of gas before smoke flows out of powder discharge port 12.

Figure 5:
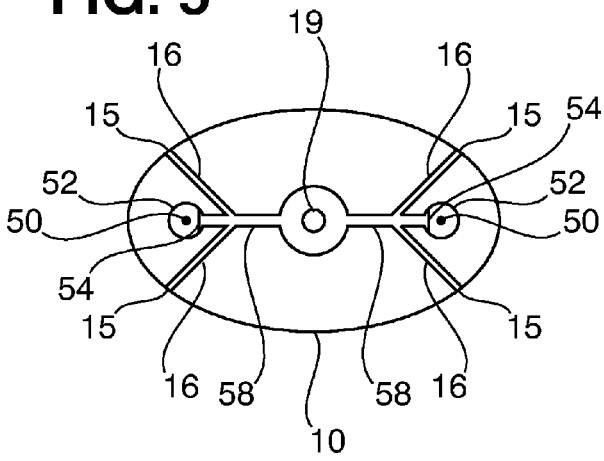
FIG. 5 is a sectional side view of the aerosol smoke grenade of FIG. 1 along section 5-5.

Rupture disc 54 breaks under gas pressure, allowing carbon dioxide gas to flow through aspirating nozzle 58. As seen in FIG. 5, tubes 16 provide fluid communication with air aspiration ports 15 traversing outer container 10 and port 56 in aspirating nozzle 58. The flow of carbon dioxide through aspirating nozzle 58 causes air to be aspirated into the aspirating nozzle 58 by the venturi effect so that the combined gas flow volume is 2 to 6 times the volume of gas flowing out of the cylinder. The gas flows into the entry junction 60 of agitator tube 65.

Figure 4:
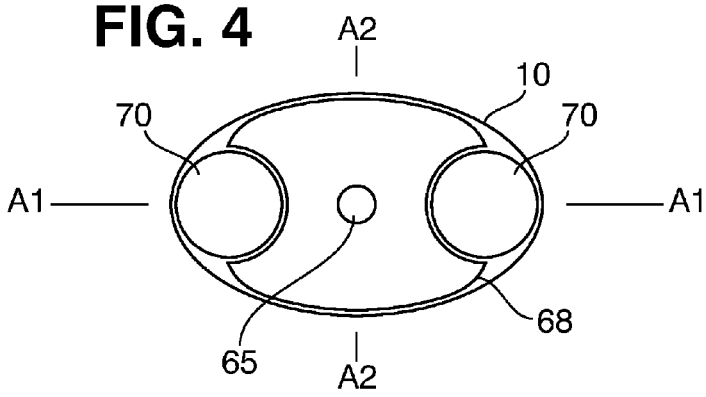
FIG. 4 is a sectional side view of the aerosol smoke grenade of FIG. 1 along section 4-4.

Agitator tube 65 is positioned in smoke powder reservoir 68, also shown in FIG. 4. The carbon dioxide/air mixture flows through multiple ports 66 into powder reservoir 68 and erodes and entrains powder on the way to discharge conduit 75.

Smoke powder reservoir 68 contains packed powder for smoke or an obscurant. Smoke and obscurant compositions include a variety of metals, carbon and the like materials in the form of finely divided, solid particles. Such materials are used in the form of solid, finely divided powders, particles, flakes and the like collectively referred to herein as powder. Exemplary materials include titanium dioxide (TiDi), white silica powder, aluminum flakes, copper flakes, brass flakes and carbon flakes. Suitable finely divided solid particles or the like smoke forming materials may be prepared by conventional well known techniques. In addition, the powder may include inert powders to improve flow characteristics. The particle size and particle size distribution of the smoke forming materials can vary depending on the material used as well as the method of their preparation, as is known in the art.

In the alternative, smoke powder reservoir 68 contains a packed particulate non-lethal lachrymator powder. The particulate lachrymator is a powdered pepper derived substance, for example, oleoresin capsicum or capsaicin. CS (orthochlorobenzalmalononitrile) is tear gas powder. The active ingredient is in amount of at least 1% up to about 30%, with the remainder made up of an inert particulate matter or a marking particulate matter such as dye powder. More than one non-lethal irritant substance may be combined to provide a total of about 1% to about 30% or more lachrymator substance in the capsule.

Reference is made to FIG. 2 and FIG. 3 showing discharge conduit 75. The end portion of discharge conduit 75 is a race 80 between smoke discharge port 12 and smoke discharge port 14. Stopper 85 seen here as a ball travels under the influence of gravity in race 80 between smoke discharge port 12 and smoke discharge port 14. The two smoke discharge ports are proximate opposite ends of the minor axis A2. In use, one port is vertically below the other with the lower port blocked by stopper 85 under the influence of gravity.

Smoke discharges from the upper port that is not blocked by stopper 12. The smoke is carried typically by 3 times the gas that would be carried by gas from the cylinder alone. As a result, the smoke plume is larger and potentially higher than it would be with only gas from the cylinder. In addition, no gas is propelled in the downward direction and thereby rendered ineffective.

The foregoing discussion discloses and describes embodiments of the invention by way of example. One skilled in the art will readily recognize from this discussion, that various changes, modifications and variations can be made therein without departing from the spirit and scope of the invention as defined in the following claims.

What is claimed is:

1. An aerosol smoke grenade comprising:

a. a canister having a curved side wall, the curved side wall having a cross-section with a major axis and a minor axis, the major axis having a greater length than the minor axis, b. a compressed gas cartridge, c. an actuator for initiating compressed gas flow from the gas cartridge, d. an aspiration nozzle in direct flow communication with the compressed gas cartridge, the aspiration nozzle having at least one air aspiration port and a discharge end, e. a powder reservoir in fluid communication with the nozzle discharge end, the powder reservoir having a discharge conduit, f. the discharge conduit providing transport of compressed gas, aspirated air and powder to two powder discharge ports traversing the side wall proximate opposite ends of the minor axis, and g. a gravity operated valve operable to close one powder discharge port.

2. The aerosol smoke grenade of claim 1, wherein the gravity operated valve includes a race between the two powder discharge ports and a ball stopper operable to close one powder discharge port.

3. The aerosol smoke grenade of claim 1, wherein the discharge conduit forms a race between the two powder discharge ports.

4. The aerosol smoke grenade of claim 1, wherein the discharge conduit forms a race between the two powder discharge ports with a ball stopper free to travel in the race between the two powder discharge ports.

5. The aerosol smoke grenade of claim 1, including an air tube providing flow communication between the air aspiration port in the aspirating nozzle and air intake ports traversing the curved side wall of the canister.

6. The aerosol smoke grenade of claim 1, wherein the actuator is manually actuatable.

7. The aerosol smoke grenade of claim 1, wherein the actuator is a manually operated bayonet.

8. The aerosol smoke grenade of claim 1, including a rupture disk between the compressed gas cartridge and the aspiration nozzle.

9. The aerosol smoke grenade of claim 1, additionally comprising an expansion chamber joining the cartridge and the aspiration nozzle.

10. The aerosol smoke grenade of claim 1, additionally comprising an expansion chamber and rupture disc joining the cartridge and the aspiration nozzle.

11. The aerosol smoke grenade of claim 1, wherein the major axis is greater in length than the minor axis by a ratio of 4:1 to 1.5:1.

12. The aerosol smoke grenade of claim 1, wherein the major axis is greater in length than the minor axis by a ratio of 2.5:1 to 1.5:1.

13. An aerosol smoke grenade comprising:

a. a containment body having a generally elliptically curved side wall, the side wall having a cross-section with a major axis and a minor axis, the major axis greater in length than the minor axis, b. a compressed gas cartridge, c. an actuator for initiating compressed gas flow from the gas cartridge, d. an aspiration nozzle in direct flow communication with the compressed gas cartridge, the aspiration nozzle having at least one air aspiration port and a discharge end, e. an expansion chamber providing fluid communication between the nozzle discharge end and a powder reservoir, f. the powder reservoir having a smoke discharge conduit, the discharge conduit providing fluid communication with two powder discharge ports traversing the side wall proximate opposite ends of the minor axis, g. a race between the two powder discharge ports with a ball stopper free to move between the two powder discharge ports under the force of gravity.

14. The aerosol smoke grenade of claim 13, wherein the discharge conduit forms the race between the two powder discharge ports.

15. The aerosol smoke grenade of claim 13, wherein an air tube provides flow communication between the air aspiration port in the aspirating nozzle and air intake ports traversing the curved side wall.

16. The aerosol smoke grenade of claim 13, wherein the actuator is manually actuatable.

17. The aerosol smoke grenade of claim 13, wherein the actuator is a manually operated bayonet.

18. The aerosol smoke grenade of claim 13, including a rupture disk between the gas cartridge and the aspiration nozzle.

19. The aerosol smoke grenade of claim 13, additionally including an expansion chamber joining the cartridge and the aspiration nozzle.

20. The aerosol smoke grenade of claim 13, additionally including an expansion chamber and rupture disc joining the cartridge and the aspiration nozzle.

21. The aerosol smoke grenade of claim 13, wherein the major axis is greater in length than the minor axis by a ratio of 4:1 to 1.5:1.

22. The aerosol smoke grenade of claim 13, wherein the major axis is greater in length than the minor axis by a ratio of 2.5:1 to 1.5:1.

* * * * *